US008662423B2

(12) United States Patent
Wilbraham

(10) Patent No.: US 8,662,423 B2
(45) Date of Patent: Mar. 4, 2014

(54) FUEL-INJECTOR NOZZLE

(75) Inventor: Nigel Wilbraham, Stourbridge (GB)

(73) Assignee: Siemens Aktiengesellschaft, Munich (DE)

( * ) Notice: Subject to any disclaimer, the term of this patent is extended or adjusted under 35 U.S.C. 154(b) by 869 days.

(21) Appl. No.: 12/513,023

(22) PCT Filed: Sep. 6, 2007

(86) PCT No.: PCT/EP2007/059320

§ 371 (c)(1),
(2), (4) Date: Apr. 30, 2009

(87) PCT Pub. No.: WO2008/052830

PCT Pub. Date: May 8, 2008

(65) Prior Publication Data

US 2010/0065663 A1 Mar. 18, 2010

(30) Foreign Application Priority Data

Nov. 2, 2006 (GB) ..... 0621798.8

(51) Int. Cl.
*B05B 5/00* (2006.01)

(52) U.S. Cl.
USPC ..... 239/690; 239/463; 239/466; 239/494; 239/497; 239/399

(58) Field of Classification Search
USPC ..... 239/690, 695, 696, 697, 699, 700, 701, 239/704, 706, 708, 86, 449, 450, 371, 419, 239/424, 416.3, 416.4, 690.1, 705, 707, 239/403, 404, 405, 406, 399, 461, 463, 466, 239/491–497, 499; 60/776, 740
See application file for complete search history.

(56) References Cited

U.S. PATENT DOCUMENTS

| | | | | |
|---|---|---|---|---|
| 439,980 | A | 11/1890 | Spink | |
| 3,167,109 | A * | 1/1965 | Wobig | 239/690 |
| 3,749,545 | A * | 7/1973 | Velkoff | 431/2 |
| 3,841,824 | A * | 10/1974 | Bethel | 431/8 |

(Continued)

FOREIGN PATENT DOCUMENTS

| | | |
|---|---|---|
| EP | 1139021 A2 | 10/2001 |
| RU | 2160414 C2 | 12/2000 |
| RU | 2235113 C1 | 8/2004 |
| SU | 689738 A1 | 10/1979 |

OTHER PUBLICATIONS

A.J. Kelly, "The Electrostatic Atomization of Hydrocarbons", Journal of the Institute of Energy, Jun. 1984, pp. 312-320.

*Primary Examiner* — Jason Boeckmann

(57) ABSTRACT

A nozzle for a fuel injector, in particular for a gas-turbine engine, is provided comprising a planar conductive electrode with a sharp edge forming an aperture, an upper insulation layer above the electrode and a lower insulation layer below the electrode, both insulation layers having apertures, and a swirler arrangement for creating a swirling action in liquid fuel introduced into the nozzle. The axis of swirl is generally perpendicular to the plane of the electrode. In use, the swirling fuel passes through the aperture of the lower insulation layer, the aperture of the conductive electrode and the aperture of the upper insulation layer. As the fuel passes through the aperture of the electrode, the electrode charges the swirling fuel, so that the nozzle supplies charged droplets of atomized fuel from an outlet orifice. The swirler arrangement may be a radial or axial swirler arrangement.

16 Claims, 5 Drawing Sheets

(56) References Cited

U.S. PATENT DOCUMENTS

| | | | | | |
|---|---|---|---|---|---|
| 4,664,315 | A | * | 5/1987 | Parmentar et al. | 239/706 |
| 5,456,596 | A | * | 10/1995 | Gourdine | 431/9 |
| 5,515,681 | A | * | 5/1996 | DeFreitas | 60/740 |
| 5,588,299 | A | * | 12/1996 | DeFreitas | 60/740 |
| 5,590,517 | A | * | 1/1997 | DeFreitas | 60/776 |
| 6,206,307 | B1 | * | 3/2001 | Kelly et al. | 239/690 |
| 6,470,684 | B2 | * | 10/2002 | Wilbraham | 60/737 |
| 6,474,573 | B1 | | 11/2002 | Kelly | |
| 2004/0069864 | A1 | | 4/2004 | Gau | |
| 2005/0116070 | A1 | * | 6/2005 | Ganan Calvo et al. | 239/706 |
| 2007/0080246 | A1 | * | 4/2007 | Fedorov et al. | 239/690.1 |

* cited by examiner

FUEL-INJECTOR NOZZLE

CROSS REFERENCE TO RELATED APPLICATIONS

This application is the US National Stage of International Application No. PCT/EP2007/059320, filed Sep. 6, 2007 and claims the benefit thereof The International Application claims the benefits of Great Britain application No. 0621798.8 GB filed Nov. 2, 2006, both of the applications are incorporated by reference herein in their entirety.

FIELD OF INVENTION

The invention relates to a nozzle for a fuel injector, and to a nozzle for a fuel injector supplying atomised liquid fuel to a device such as a gas-turbine engine.

BACKGROUND OF INVENTION

Fuel-injector nozzles for supplying atomised droplets of liquid fuel to a combustion chamber in a gas-turbine engine are already known. One example is described in European patent application EP 1139021, which was published on 4 Oct. 2001 and involves the same inventor as the present application. FIGS. 1-3 of EP 1139021 are reproduced here as FIGS. 1-3 of this present application.

FIG. 1 shows a combustor for a gas-turbine engine, comprising a burner 10, a swirler 12, a pre-chamber 14 and a main combustion chamber 16. The swirler 12 includes a number of vanes 18 (see also FIG. 2) defining intervening passages 20, which are fed with compressed air from a manifold 22. The combustor may run off liquid fuel, in which case liquid fuel is introduced through nozzles 24 at the burner face 26. The nozzles 24 can operate in two different modes depending on the load condition. At high load the feed pressure, and hence the flow through the nozzle, is high enough to achieve good atomization of the fuel without the nozzle being electrically charged. However, at low load the flow is reduced and therefore the atomization is impaired. Hence, as the load is decreased, the voltage applied in the nozzle is increased, giving rise to enhanced atomization.

FIG. 2 is a plan view of the swirler 12 and burner 10 and showing the injection nozzles 24 arranged circumferentially around the burner, while FIG. 3 shows an injection nozzle 24 in greater detail. The nozzle 24 comprises a nozzle body 26 having a circular-section spin chamber 28. Liquid fuel is fed into the spin chamber 28 through an array of slots 30 and is thrown out through a throat 32 and passage 34, which is frustoconical in shape, in direction A to an outlet orifice 36. Due to the strong swirling movement of the fuel in the spin chamber, the fuel tends to keep to the inside surface 38 of the passage 34 and is atomised to faun small droplets as it expands out of the passage 34 into the air stream present in the swirler passages 20.

A tubular, electrically conductive electrode 40 is provided near the outlet end of the nozzle 24. The electrode 40 has a sharp edge 42, which extends in the direction of travel of the fuel through the nozzle. Insulating layers 44, 46 are provided on respective sides of the electrode 40.

The fuel is subjected to an electrostatic charge at the point where the fuel stream, which keeps to the inside wall 38, starts to break up into droplets as it exits the outlet 36. A charge supply and control unit 48 (see FIG. 1) feeds the electrode 40 with a voltage via an annular conductor 50.

Electrostatic charging of the fuel is beneficial mainly when the engine is running at low loads, i.e. when less fuel is being delivered to the nozzles 24. Such charging then helps to control the atomisation and vaporisation of the fuel, the fuel placement and combustion intensity. By contrast, it may not be necessary to employ electrostatic charging when the engine is running at full load.

The fuel-injection nozzle disclosed in EP 1139021 has the drawback that it is complex and thereby costly to manufacture. In addition the volume occupied by the nozzle is quite large, especially in the axial direction.

SUMMARY OF INVENTION

The present invention seeks to mitigate these drawbacks.

In accordance with the invention there is provided a nozzle for a fuel injector for supplying atomised liquid fuel, the nozzle comprising: an electrode comprising a substantially planar electrically conductive member containing an aperture, the edge of the aperture being sharp to enable the electrode to impart charge; first and second insulating members disposed to respective sides of the plane of the electrically conductive member, the first insulating member being disposed on an outlet side of the nozzle, and swirler means for supplying a swirling flow of liquid fuel to the aperture, the axis about which the fuel swirls within the aperture being generally perpendicular to the plane of the electrode, wherein, in use of the nozzle, the electrode imparts charge to the swirling flow of liquid fuel within the aperture such that the nozzle supplies charged droplets of atomised fuel.

The first and second insulating members may have first and second apertures, respectively, which are substantially coaxial with the aperture of the conductive member. The second aperture may be larger than the first aperture. Furthermore, the aperture of the conductive member may be smaller than the first aperture.

The conductive member may have a thickness, which decreases in a radial direction between the second aperture and the aperture of the conductive member. The decrease in thickness of the conductive member may be substantially linear.

The nozzle may further comprise first and second substantially planar members disposed on outer planar sides of the first and second insulating members, respectively, the first substantially planar member comprising an outlet orifice for the supplying of the charged droplets of atomised fuel. The outlet orifice is preferably substantially the same size as the first aperture.

The swirler means may be a radial swirler means, which may comprise radial passages provided in the second insulating member and communicating with the second aperture.

Alternatively, the swirler means may be an axial swirler means. In this case passages may be provided in the second substantially planar member and communicating with the second aperture, said passages being oriented such as to impart an axial and a tangential component of flow to incoming fuel.

BRIEF DESCRIPTION OF THE DRAWINGS

Embodiments of the invention will now be described, by way of example only, with reference to the accompanying drawings, of which.

DETAILED DESCRIPTION OF INVENTION

Figure 4B:
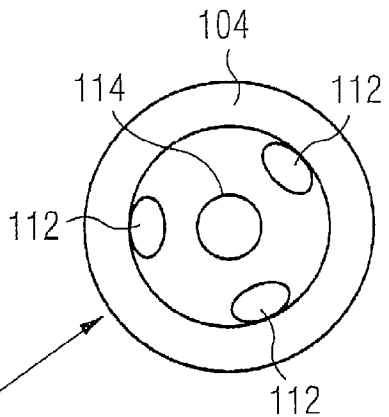
FIG. 4(*a*) is a sectional view through a generalised fuel-injection nozzle according to the present invention and FIG. 4(*b*) is a plan view of part of FIG. 4(*a*)
Figure 4A:
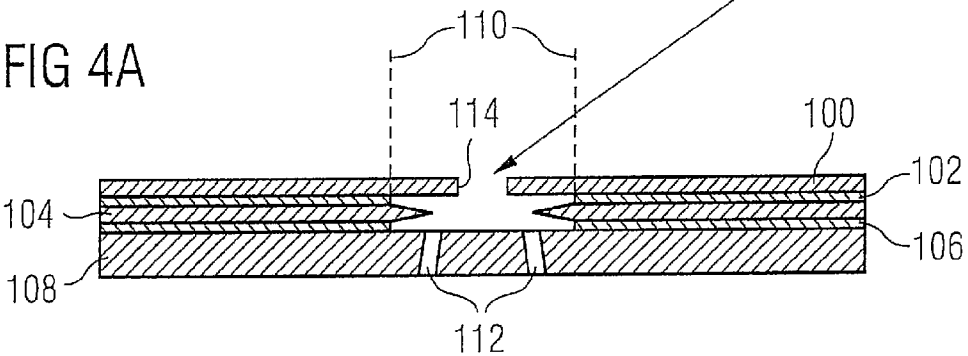
Figure 3:
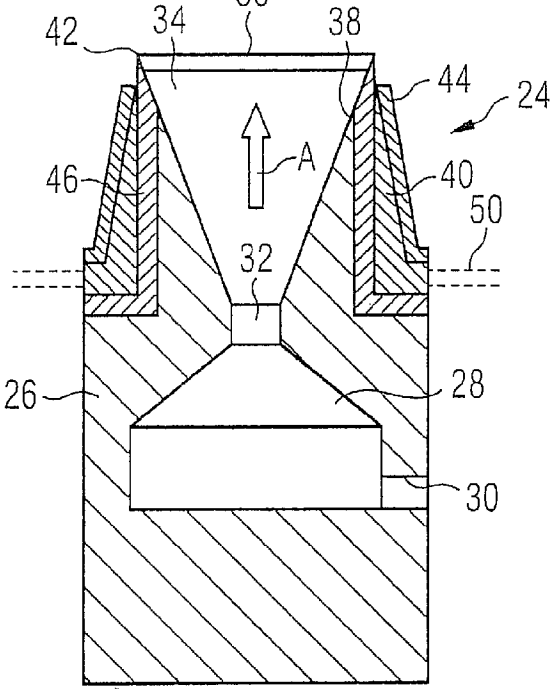
FIG 3 Prior Art

Referring now to FIG. 4(*a*), a generalised representation of a fuel-injection nozzle according to the present invention is shown, which comprises a laminar arrangement of components. These components are: an upper, or first, planar member 100, an upper, or first, planar layer of insulation 102, a planar conductive member 104, a lower, or second, planar layer of insulation 106 and a lower, or second, planar member 108. It is understood that by "planar" is meant that the relevant components are generally, or substantially, flat, and not necessarily completely and uniformly flat. These members and layers are held together in any suitable manner, for example by clamping. FIG. 4(*b*) is a view of FIG. 4(*a*) looking down from just above the conductive layer 104 and including solely the central circular portion of the nozzle demarcated by lines 110.

The planar members 100, 108 are preferably composed of metal, while the insulation layers are preferably composed of mica or a ceramic material. Silicon-based compounds are not suitable, since they are attacked by hydrocarbons. In order to resist erosion and maintain sharpness over a long period, the conductive member 104 is preferably composed of a hard, heat-resistant material, such as the high-speed tool steel or Stellite 6™ mentioned in EP 1139021.

There are provided in one of the lower components, e.g. the lower planar member 108, a series of holes 112, which are disposed such as to impart a rotational component of flow to liquid fuel flowing through these holes. The swirling fuel enters the space defined by lines 110, flows past the conductive member 104 and out through the outlet orifice 114, emerging as droplets of fuel. Along the way, the fuel picks up electronic charge produced by the application of a suitably high voltage between the conductive member 104 and a reference-potential point (e.g. earth). Since the planar members 100 and 108 are made of metal, it is assumed that they will likewise be held at a reference-potential point, e.g. earth.

Figure 1:
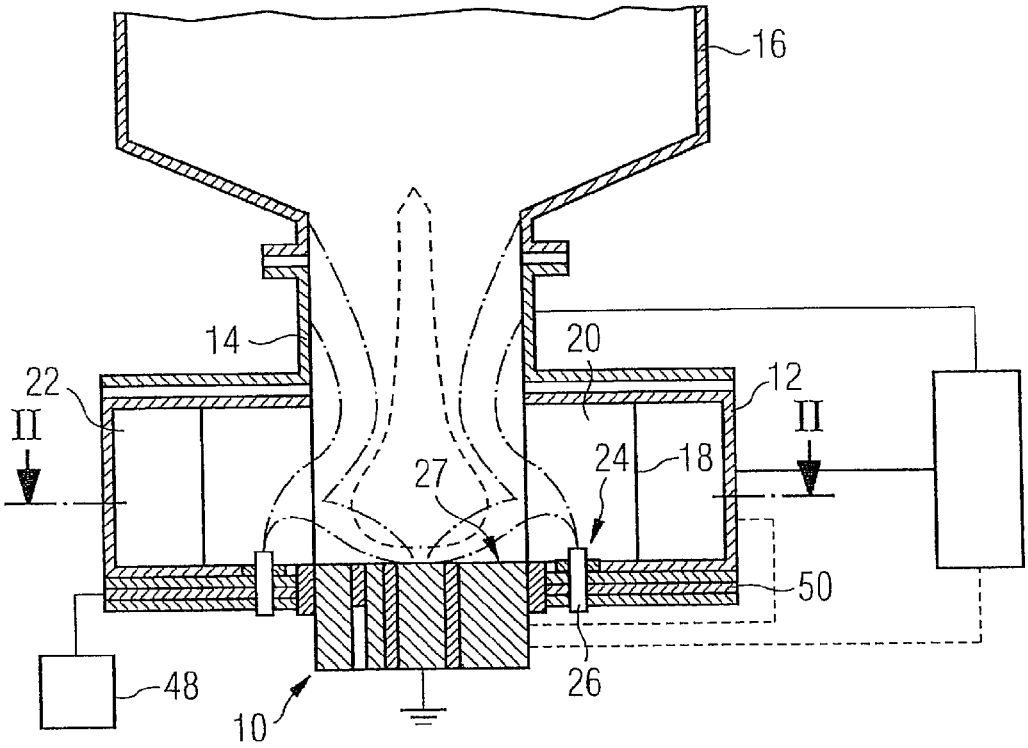
FIG 1 Prior Art
FIGS. 1 and 2 are sectional views of a known gas-turbine combustion system and FIG. 3 is a sectional view through a known fuel-injection nozzle used in the combustion system of FIGS. 1 and 2.
Figure 2:
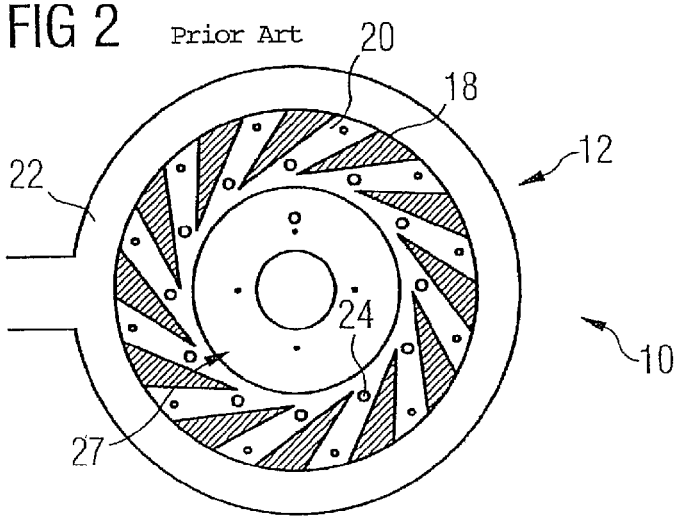
FIG 2 Prior Art
Figure 5:
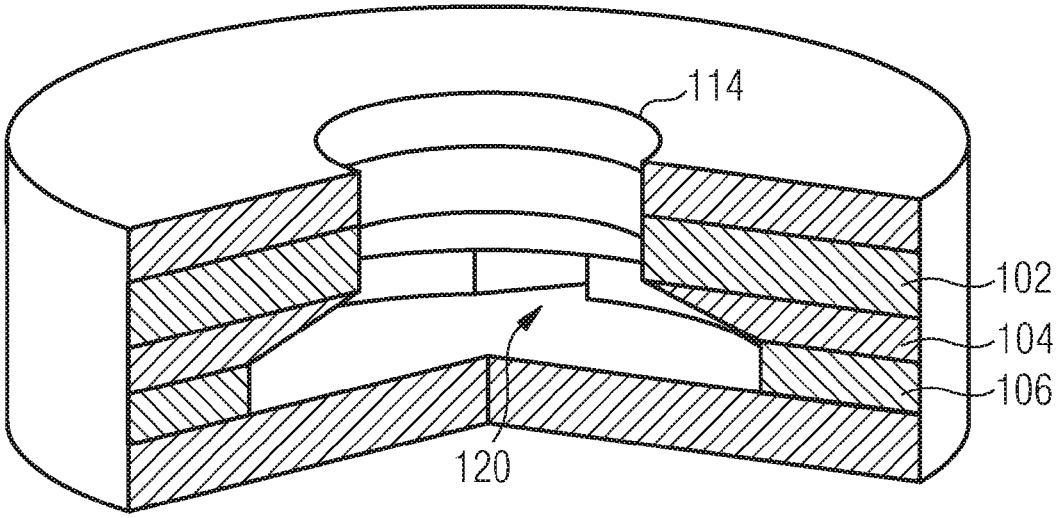
FIG. 5 is a perspective view of a first embodiment of the nozzle shown in FIG. 4(*a*)

A first, more practical, nozzle arrangement corresponding to a first embodiment of the invention is shown in FIG. 5. In FIG. 5, which is a perspective view of the nozzle, the liquid fuel is introduced by way of passages 120 provided in the lower insulation layer. These passages correspond to the passages 20 shown in FIGS. 1 and 2 and therefore impart a large tangential and a smaller radial component of flow to the incoming fuel. The swirling fuel occupies first the aperture formed in the lower insulation layer 106, then rises into the smaller aperture formed in the upper insulation layer 102, passing on the way the sharp edge of the conductive member 104. The charging action of the conductive member is as explained in connection with FIG. 4(*a*). Finally, the still swirling fuel passes through the apertures of the upper insulation layer 102 and upper planar member 100, which are of roughly equal size, and exits the nozzle through the outlet orifice 114, where it appears as charged droplets.

Figure 6:
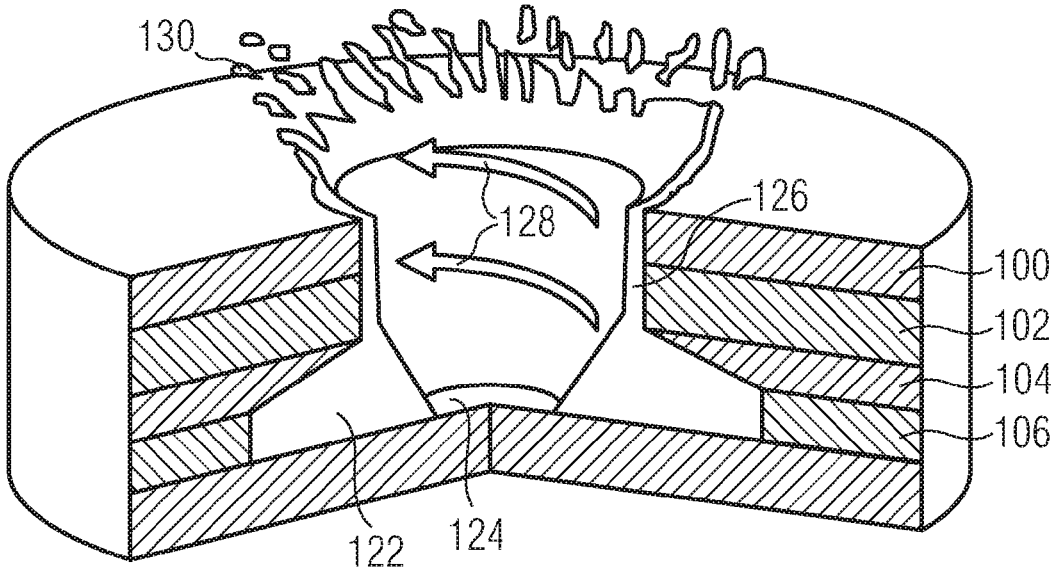
FIG. 6 and FIGS. 7(*a*) and 7(*b*) correspond to the view of FIG. 5 and illustrate the mode of operation of the nozzle.

The operation of the nozzle is seen in greater detail in FIG. 6. The incoming fuel fills the outer portion 122 of the aperture of the lower insulation layer, while avoiding the inner portion 124. Thus the outer portion 22 constitutes a spin chamber and the portion 124 remains a void in the nozzle. This action results from the centrifugal force exerted on the fuel by the swirling motion. In the diagram this force is such as to give rise to a direction of rotation 128 of the fuel. As a result a thin film of fuel 126 is formed in the vicinity of the conductive member 104, upper insulation layer 102 and upper planar member 100. Thus the fuel is readily charged as it rises past the edge of the conductive member 104. The emerging atomised fuel can be seen as droplets 130.

Figure 7A:
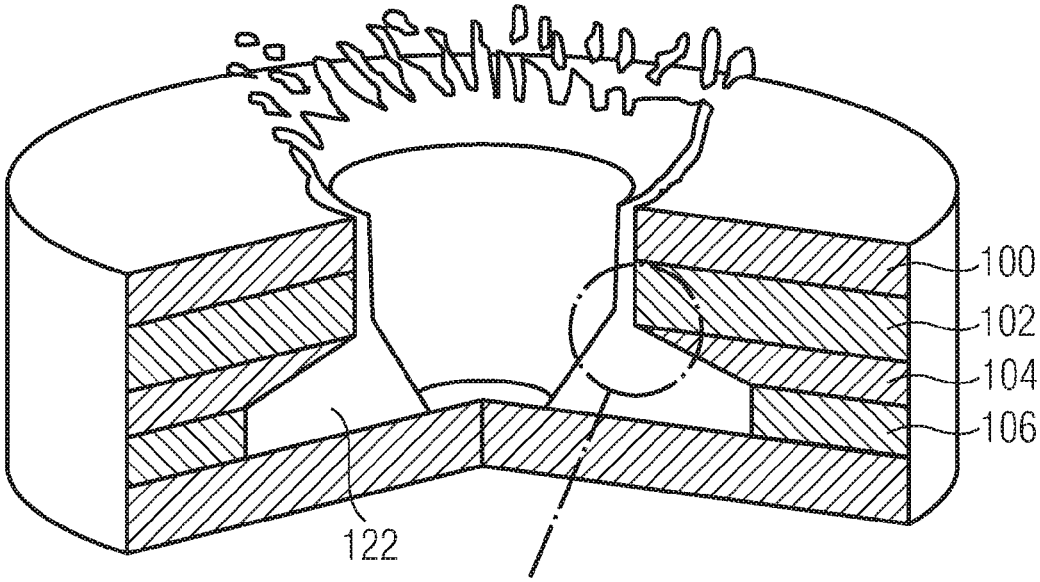
Figure 7B:
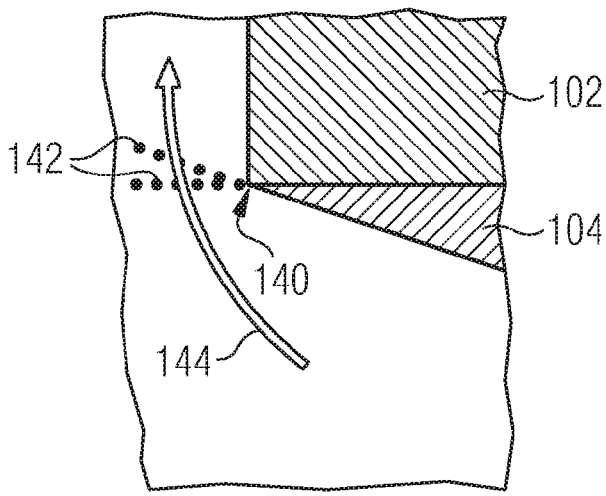

The detail of the construction and action of the conductive member 104 is illustrated in FIGS. 7(*a*) and 7(*b*). FIG. 7(*a*) corresponds to FIG. 6. The part of FIG. 7(*b*) highlighted by a broken circle is shown in greater detail in FIG. 7(*b*). In this diagram, the electron flux from the sharp edge 140 is shown by the dotted lines 142 and the direction of the fuel, which swirls past the sharp edge, is shown by the arrow 144. Incidentally, it is preferable if the sharp edge of the conductive member 104 does not protrude past the upper insulation layer 102, in order to avoid the possibility of turbulence being created in this region.

The conductive member 104 has a thickness, which decreases substantially linearly between the annulus forming the aperture of the lower insulation layer 106 and the annulus forming the aperture of the upper insulation layer 102. This assists the flow of the liquid fuel from the spin chamber 122 into the passage formed by the apertures of the upper insulation layer 102 and upper planar member 100.

Figure 8A:
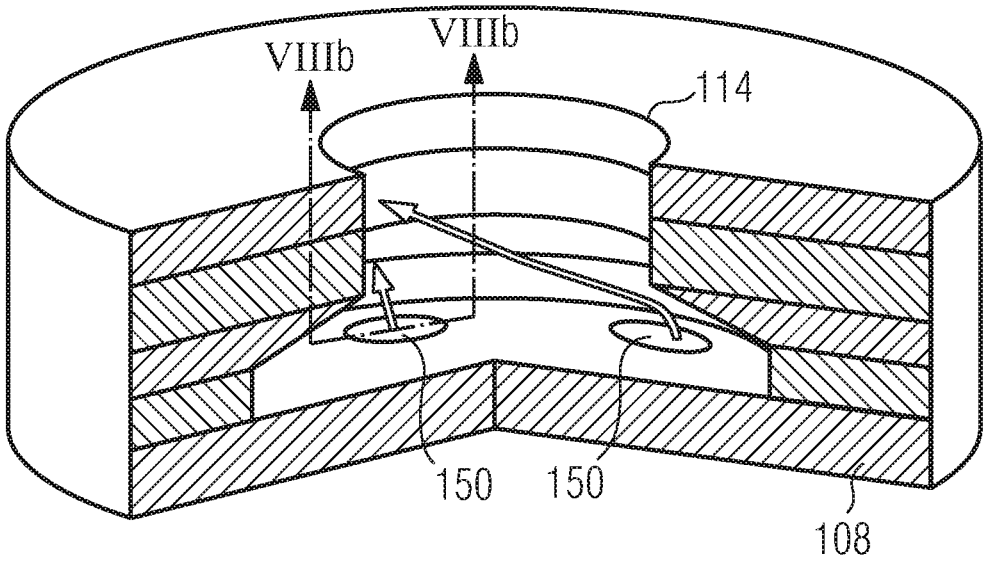
FIG. 8(*a*) is a perspective view of a second embodiment of the nozzle shown in FIG. 4(*a*), and FIGS. 8(*b*) and 8(*c*) are a sectional view and a plan view, respectively, of a lower substantially planar member forming part of the nozzle of FIG. 8(*a*).
Figure 8B:
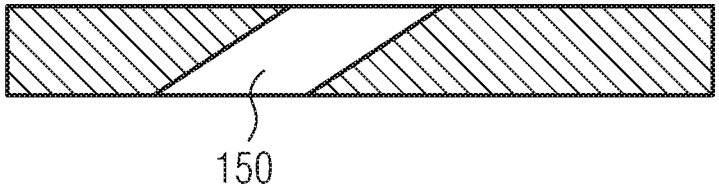
Figure 8C:
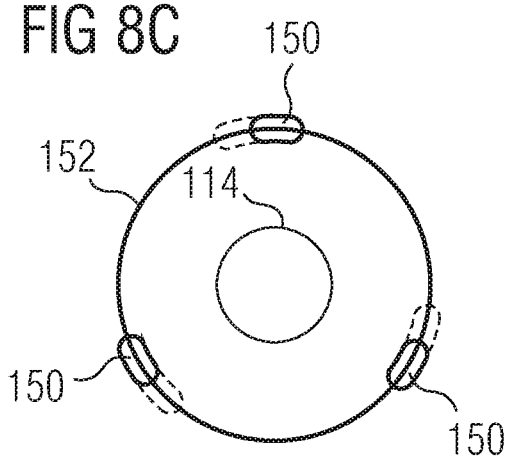

A second embodiment of a nozzle in accordance with the invention is illustrated in FIGS. 8(*a*)-8(*c*). In this embodiment the swirler action is created by an axial arrangement of fuel slots 150. These slots 150 are formed in the lower planar member 108. FIG. 8(*b*) is a sectional view through the lower planar member along lines VIIIb in FIG. 8(*a*) and shows the angled orientation of the slots through the lower planar member. This angled orientation is in a direction roughly tangential to an imaginary circle 152 running through the slots 150, as shown in FIG. 8(*c*). Thus the incoming fuel assumes both axial and tangential components of flow in the spin chamber. The action is similar to that of the radial-swirler version of FIGS. 5-7, except that the fuel is accelerated more through the nozzle, due to the axial flow component.

When the edge 140 of the electrode 104 is referred to as sharp, this means sufficiently sharp to effectively impart charge to the fuel droplets as they rapidly leave the outlet 114 of the nozzle. Purely as an example, it is considered that this requirement could be met with an edge 140 having an included angle of about one half of a degree, and a radius of not more than about one micron, though these are not hard and fast figures.

Although it has been assumed that the electrode 104 will have a bevelled profile at its radially inner extremity, this is not absolutely necessary. It is, however, preferred, as mentioned earlier, in order to improve the flow characteristics of the fuel as it passes from the inlet passages into the aperture region of the electrode 104 and first planar layer 102.

In order to ensure that the electrons discharged from the conductive member can reliably charge the passing fuel, account is ideally taken of the tendency of the electrons to flow to ground through the hydrocarbon fuel, which is usually electrically conductive. This is achieved by arranging for a suitable rate of flow of the liquid fuel past the conductive member.

Details on how to determine a suitable flow rate through the nozzle are contained in, for example, the paper "The Electrostatic Atomization of Hydrocarbons" by A. J. Kelly, Journal of the Institute of Energy, June 1984, pp 312-320. According to this paper, most commercial hydrocarbons have an electrical breakdown strength in the region of $2\times10^7$ V/m. Once charge has been injected into the fuel stream by the charging electrode, it stagnates in the fluid. Subsequently, the charge is acted upon by the fluid flow and the electrical forces which act to attract the charge to the orifice electrode. As mentioned earlier, this orifice electrode (the planar member 100 in the present invention) will be held at a reference potential relative to the potential on the charging electrode (the electrode 104 in the present invention). For commercial oxygenated hydrocarbons, the electrical mobility is commonly in the range of $10^{-7}$-$10^{-8}$ $m^2/V\cdot sec$. (The electrical mobility is the ratio of the limiting velocity, to which a particle is accelerated in the presence of an electric field, to the magnitude of that field). Therefore, for a maximum electrical field of $2\times10^{-7}$ V/m, the mobility of the charge will be approximately 2 m/s. This means that the fluid should ideally be flushed through the nozzle at a speed >2 m/s in order to reliably retain charge and provide good atomization.

It should be noted that the dielectric constant (electrical breakdown strength) for biofuels is approximately 50% higher than that for standard fuels. Consequently, if most commercial fuels have a dielectric constant of $2\times10^7$ V/m, as mentioned above, then most biofuels will have a dielectric constant of around $3\times10^7$ V/m. Since it is assumed that the electrical mobility for biofuels is roughly the same as for standard fuels—i.e. approximately $10^{-7}$-$10^{-8}$ $m^2/Vs$—then a nozzle flow speed of ~3 m/s would be required, if the same charging efficiency were to be maintained.

In an analogous manner, if a silicone oil were to be employed as the fuel passing through the nozzle, this would have a dielectric constant of about $1.5\times10^7$ V/m. Again, on the assumption that the electrical mobility for biofuels is of the same order as that for standard fuels, a nozzle flow speed of 1.5 m/s would be suitable.

The invention claimed is:

1. A nozzle for a fuel injector to supply an atomised liquid fuel, the nozzle comprising:

a laminar arrangement of components, comprising:

an electrode comprising a substantially planar electrically conductive member containing an electrode aperture, an edge of the electrode aperture enabling the electrode to impart a charge, a first planar member and a second planar member, and a first insulating member and a second insulating member, the first insulating member located above the electrode and the second insulating member located below the electrode, the first insulating member located on an outlet side of the nozzle; and a swirler supplying a swirling flow of a liquid fuel to the electrode aperture; and wherein an axis about which the liquid fuel swirls within the electrode aperture is generally perpendicular to the plane of the electrode and the laminar arrangement, and wherein the edge of the electrode aperture imparts the charge to the swirling flow of liquid fuel within the electrode aperture whereby the nozzle supplies a plurality of charged droplets of atomised fuel, wherein the first planar member is located on an outer planar side of the first insulating member and the second planar member located on an outer planar side of the second insulating member, wherein the first insulating member has a first aperture and the second insulating member has a second aperture, respectively, which are substantially coaxial with the electrode aperture, and wherein the first planar member comprises an outlet orifice to supply the plurality of charged droplets of atomised fuel.

2. A nozzle as claimed in claim 1, wherein the outlet orifice is essentially a same size as the first aperture.

3. A nozzle as claimed in claim 1, wherein a plurality of members, including the first insulating member, the second insulating member, the first planar member, the second planar member, and the electrode, are held together by a clamp.

4. A nozzle as claimed in claim 1, wherein the first planar member and the second planar member are composed of a metal.

5. A nozzle as claimed in claim 1, wherein the second planar member has a plurality of holes to impart a rotational component of flow to the liquid fuel flowing through the plurality of holes.

6. A nozzle as claimed in claim 1, wherein the swirler is a radial swirler.

7. A nozzle as claimed in claim 6, wherein the radial swirler further comprises a plurality of radial passages provided in the second insulating member and communicating with the second aperture.

8. A nozzle for a fuel injector to supply an atomised liquid fuel, the nozzle comprising:

a laminar arrangement of components, comprising:

an electrode comprising a substantially planar electrically conductive member containing an electrode aperture, an edge of the electrode aperture enabling the electrode to impart a charge, a second substantially planar member, and a first insulating member and a second insulating member, the first insulating member located above the electrode and the second insulating member located below the electrode, the first insulating member located on an outlet side of the nozzle; and a swirler supplying a swirling flow of a liquid fuel to the electrode aperture; and wherein an axis about which the liquid fuel swirls within the electrode aperture is generally perpendicular to the plane of the electrode and the laminar arrangement, and wherein the edge of the electrode aperture imparts the charge to the swirling flow of liquid fuel within the electrode aperture whereby the nozzle supplies a plurality of charged droplets of atomised fuel, wherein the first insulating member has a first aperture and the second insulating member has a second aperture, respectively, which are substantially coaxial with the electrode aperture, wherein the second aperture is larger than the first aperture, wherein the swirler is an axial swirler, and wherein the axial swirler further comprises a plurality of passages provided in the second substantially planar member and communicating with the second aperture, the plurality of passages oriented to impart an axial and a tangential component of a flow to incoming liquid fuel.

9. A nozzle as claimed in claim 8, wherein the electrode aperture is smaller than the first aperture.

10. A nozzle as claimed in claim 9, wherein the electrode has a thickness which decreases in a radial direction between the second aperture and the electrode aperture.

11. A nozzle as claimed in claim 10, wherein a decrease in the thickness is substantially linear.

12. A nozzle as claimed in claim 8, wherein the first insulating member and the second insulating member are made of a mica or a ceramic material.

13. A nozzle as claimed in claim 8, wherein the electrode is made of a hard heat-resistant material.

14. A nozzle as claimed in claim 8, wherein the edge of the electrode does not protrude past the first insulating member so that turbulence is inhibited in a region near the edge.

15. A nozzle as claimed in claim 8, wherein the edge of the electrode has an included angle of one half of a degree and a radius of no more than a micron.

16. A nozzle as claimed in claim 8, wherein the electrode has a beveled profile at a radially inner extremity.

* * * * *